United States Patent [19]

Tanaka et al.

[11] Patent Number: 4,827,094

[45] Date of Patent: May 2, 1989

[54] DUAL-ACTION PRESSURE SWITCH APPARATUS

[75] Inventors: Hazime Tanaka, Yokohama; Keiji Sasaki, Tokyo; Hirayosho Suzuki, Kanagawa, all of Japan

[73] Assignee: Fuji Koki Manufacturing Co., Ltd., Tokyo, Japan

[21] Appl. No.: 214,418

[22] Filed: Jul. 1, 1988

[30] Foreign Application Priority Data

Jul. 2, 1987 [JP] Japan ..... 62-165882

[51] Int. Cl.[4] ..... H01H 35/34

[52] U.S. Cl. ..... 200/83 J; 200/81.4; 200/83 P

[58] Field of Search ..... 200/83 R, 83 J, 83 P, 200/61.25, 67 R, 67 D, 67 DH, 67 DB, 244, 250, 283, 286, 290, 81.4, 82 R, 81.5; 307/118; 92/5 R, 7, 101, 103 M, 98 R; 91/1; 73/717, 723, 744, 745, 861.47; 340/626

[56] References Cited

U.S. PATENT DOCUMENTS

| | | | |
|---|---|---|---|
| 4,091,249 | 5/1978 | Huffman | 200/83 |
| 4,220,836 | 9/1980 | Hersey | 200/83 |
| 4,243,858 | 1/1981 | Place | 200/83 |
| 4,296,287 | 10/1981 | Boulanger et al. | 200/83 |
| 4,400,601 | 8/1983 | Brucken | 200/81.4 |
| 4,473,729 | 9/1984 | Ting et al. | 200/83 |
| 4,593,166 | 6/1986 | Hirota et al. | 200/83 |
| 4,757,165 | 7/1988 | Maroux | 200/83 P |

FOREIGN PATENT DOCUMENTS

| | | |
|---|---|---|
| 57-197146 | 12/1982 | Japan . |
| 59-82935 | 6/1984 | Japan . |
| 62-23009 | 6/1987 | Japan . |
| 62-37495 | 8/1987 | Japan . |

*Primary Examiner*—Gerald P. Tolin

*Attorney, Agent, or Firm*—Brown, Martin, Haller & McClain

[57] ABSTRACT

A dual-action pressure switch apparatus has a piston member disposed in a switch mechanism containing chamber sealingly pertitioned by a diaphragm in the inner space of a housing, and being movable in the axial direction of chamber. A high-pressure snap disk is placed on the side surface of piston and contacts the diaphragm. In the chamber, a low-pressure snap disk is so arranged that its outer rim engages with the inner periphery of chamber and sandwich the piston between its center and the diaghragm. When the pressure of a pressurized fluid introduced in the inner space is lower than the lower limit of a certain range of values, both low and high snap disks are stable, so that paired resilient switch pieces disposed adjacent to the low snap disk in the chamber separate from each other. When the pressure is set in the certain range, only the low snap disk is transformed to push one switch piece to make it contact the other. When the pressure becomes higher than the upper limit of certain range, the high snap disk is then transformed to push a rod inserted through the piston and the low snap disk, so that the other switch piece is separated from the former transformed one switch piece.

20 Claims, 3 Drawing Sheets

DUAL-ACTION PRESSURE SWITCH APPARATUS

BACKGROUND OF THE INVENTION

1. Field of the Invention

The present invention relates to a dual-action pressure switch apparatus, which becomes one of turned-on state and turned-off state when the pressure of a pressurized fluid is set in a range, and which becomes the other (that is, a state opposing to the state in the range) of turned-on state and turned-off state when the pressure of the pressurized fluid becomes lower than the lower limit of the range and higher than the upper limit thereof.

2. Description of the Related Art

The dual-action pressure switch apparatus described above is used in, for example, the refrigerating cycle of an automotive air conditioner, to stop the compressor in the refrigerating cycle when the pressure of the refrigerant therein either becomes lower than the lower limit of a range, or higher than the upper limit thereof, thereby to protect the refrigerating cycle from being damaged.

U.S. Pat. Nos. 4,091,249, 4,243,858, 4,220,836, 4,473,729, and 4,296,287 disclose ON/OFF switch apparatuses which are turned on or off by the snap transformation of a snap disk caused by the pressure of a pressurized fluid attaining a certain value.

Japanese Utility Model Disclosures Nos. 57-197146 and 59-82935, U.S. Pat. No. 4,593,166, and Japanese Utility Model Publication No. 62-23009 disclose dual-action pressure switch apparatuses which use a combination of a coil spring and a snap disk or ring. In these dual-action pressure switch apparatuses, the coil spring is first compressed, to turn on a pair of contacts, when the pressure of a pressurized fluid increases and reaches the lower limit of a range, then the snap disk or ring is snap-transformed, to turn off the paired contacts, when the pressure of the pressurized fluid increases and reaches the upper limit thereof.

In a case where vibration is applied to these dual-action pressure switch apparatuses which use the coil springs when the pressure of the pressurized fluid does not reach the lower limit of the range, expansion and contraction of the coil spring caused by the vibration sometimes bring these apparatuses malfunction. In addition, these dual-action pressure switch apparatuses using coil springs tends to frequently repeat turning-on and turning-off at a very narrow point in the neighbors of upper and lower limits of the certain range. This frequent repeat of turning-on and turning-off is called as "chattering", and this produces a noise which tends to cause electronic apparatuses to wrongly operates. Further, the coil spring needs a relatively large working space in its axial direction and this makes the dimension of these dual-action pressure switch apparatuses relatively large in their axial direction. In addition, since it is difficult to accurately determine the length and spring constant of a coil spring when it is manufactured, the spring is therefore provided with a screw type urging force adjusting means. The need to provide such an adjusting means renders the dual-action pressure switch apparatus complicated in its construction, as well as large. In addition, the operation for setting the preload of the spring to a value is extremely bother-some and, moreover, the accuracy of the set preload is not high.

Constructions for eliminating the above-mentioned various drawbacks associated with the use of coil springs in a dual-action pressure switch apparatus are disclosed in Japanese Patent Publication No. 62-37495 and U.S. Pat. No. 4,400,601.

In Japanese Patent Publication No. 62-37495, the dual-action pressure switch apparatus disclosed therein makes use of the resiliency of a pair of switch-contact pieces, instead of a coil spring, and a pair of force transmission members, disposed coaxially and freely slidable in the axial direction to each other, are supported by a partition wall of a housing so as to be slidable in the axial direction, and to transmit the movement of a diaphragm and a snap disk to the switch-contact pieces.

However, it is impossible to accurately determine the value of elasticity of the switch-contact pieces when the contact pieces are manufactured. In addition, the combination of the paired coaxial force transmission members and the partition wall increases the number of parts used in the dual-action pressure switch apparatus and also makes its manufacture and assembly complicated.

In U.S. Pat. No. 4,400,601, the Dual-action pressure switch apparatus disclosed therein makes use of an additional snap disk in place of a coil spring. This pressure switch apparatus has a high-pressure ON/OFF switch, arranged on one side of a partition wall of a housing, and a low pressure ON/OFF switch and a pair of snap disks, for high and low pressures, arranged on the other side of the partition wall. This arrangement needs works for assembling of these components on both sides of the partition wall, thereby causing the assembling works to be troublesome. In addition, the construction of the apparatus is complicated because the components are arranged on both sides of the partition wall.

SUMMARY OF THE INVENTION

The present invention has been developed in consideration of the above-described drawbacks associated with the prior art, and is intended to provide a dual-action pressure switch apparatus, which uses a pair of snap disks to eliminate the above-mentioned various drawbacks in the conventional dual-action pressure switch apparatuses using the combination of the compression coil spring and the snap disk, and which is simpler in construction and easier in assembly.

The above described object of the present invention can be achieved by a dual-action pressure switch apparatus which becomes one of turned-on state and turned-off state when the pressure of a pressurized fluid is set within a range of values, and which becomes the other (that is, a state opposing to the state in the range) of turned-on state and turned-off state when the pressure of the pressurized fluid becomes lower than the lower limit of the range and higher than the upper limit thereof, the apparatus comprising: a housing having an inner space and a passage through which the pressurized fluid is introduced into the inner space; a diaphragm arranged in the inner space of the housing, so as to sealingly partition the inner space into a pressure actuating chamber, which communicates with the passage, and a switch mechanism-containing chamber, which is shielded from the passage; a piston member arranged adjacent to the diaphragm in the switch mechanism-containing chamber, so as to be movable with the center portion of the diaphragm, when the diaphragm is moved; a low-pressure snap disk arranged in the switch mechanism-containing chamber so as to be adjacent to one side surface of the piston member which is located remote form the diaphragm, and supported at the circumferential rim thereof, by the inner circumferential surface of the switch mechanism containing chamber, so as not to move in a direction in which low-pressure snap disk means departs from the diaphragm, the low-pressure snap disk means being able to change configuration, by means of a snap action, between a first configuration, in which its center portion is projected toward the diaphragm, to move the piston member thereto, and a second configuration, in which its center portion is projected to move away from the diaphragm, to move the piston member inward in the switch mechanism-containing chamber in the moving direction of said piston member, and the low-pressure snap disk means assuming the first configuration when the pressure of the fluid transmitted through the diaphragm and the piston member is lower than the lower limit of the range, and assuming the second configuration when the pressure of the fluid is higher than the lower limit thereof; a high-pressure snap disk means arranged between the diaphragm and the other side surface of the piston member, which is adjacent to the diaphragm, the high-pressure snap disk means also being able to change configuration, between a first configuration, in which its center portion is projected toward the diaphragm, and a second configuration, in which its center portion is projected to move away from the diaphragm, and the high-pressure snap disk means assuming the first configuration when the pressure of the fluid transmitted through the diaphragm is lower than the upper limit of the range, and assuming the second configuration when the pressure of the fluid is higher than the upper limit thereof; a high-pressure actuating rod inserted in the piston member and the low-pressure snap disk means so as to be movable in the moving direction of the piston member, relative to the piston member and the low-pressure snap disk means, by means of the high-pressure snap disk means changing configuration, between the first configuration and the second configuration; a dual-action switch unit arranged in the switch mechanism-containing chamber so as to be positioned more inwardly than the low-pressure snap disk means in the moving direction of said piston member, the switch unit having a pair of resilient switches being made of electrically conductive material and separated from each other in the moving direction, and being separated from or contact each other to set one of OFF-state and ON-state, when the pressure of the pressurized fluid is lower than the lower limit of the range and both of the snap disk means are in first configuration, one of the paired resilient switch pieces being pushed by either the low-pressure snap disk means, which is in the second configuration or by the piston member which is moved inwardly within the switch mechanism-containing chamber by means of the low-pressure snap disk means changing configuration, from the first configuration to the second configuration, and thus being transformed to contact or separate from the other resilient switch piece and to set the other of ON-state and OFF-state, when the pressure of the pressurized fluid is set within the range and the low-pressure snap disk means is in the second configuration while the high-pressure snap disk means is in the first configuration, and the other resilient switch piece being pushed by the high-pressure actuating rod which moves inwardly in the switch mechanism-containing chamber with the high-pressure snap disk means changing configuration, from the first configuration to the second configuration, and thus being transformed to separate from or contact the one resilient switch piece which has been transformed as described above to set the above described one of OFF-state and ON-state, when the pressure of the pressurized fluid is higher than the upper limit of the range and both of the snap disk means are in the second configuration; and a pair of terminals whose one ends are electrically connected to the paired resilient switch pieces of the dual-action switch unit while the other ends thereof being projected outside the housing.

In the dual-action pressure switch apparatus having the above-described arrangement according to the present invention, it is preferable, for ease of assembly, that the housing include a first housing section having a pressure actuating chamber and a passage through which pressurized fluid can be introduced into the chamber, and a second housing section, which has the switch mechanism-containing chamber and which is detachably connected to the first housing section, and that the diaphragm be sealingly secured at its circumferential rim to the portion connecting the first and second sections.

In addition, it is preferable that the diaphragm be in the form of a synthetic resin film, since this is easier, and thus cheaper, to manufacture.

Further, it is preferable that the high-pressure snap disk means comprise a plurality of snap disks coaxially overlapping one another, since this construction is more durable and makes it easier to determine the pressure value which causes the snap action of the snap disk means to occur.

It is also preferable, for the sake of compactness, that one of the paired resilient switches of the dual-action switch unit have a through-hole through which the high-pressure actuating rod is inserted, and that the resilient switch piece in question be located nearer the low-pressure snap disk means than the other resilient switch.

It is also preferable that the piston member have a low-pressure actuating projection formed in a ring configuration on the one side surface thereof which is remote from the diaphragm, to surround the peripheral surface of the high-pressure actuating rod and inserted through the low-pressure snap disk means, so as to project toward the paired resilient switch pieces of the dual-action switch unit, and that the low-pressure actuating projection pushes the one of the paired resilient switch pieces toward the other thereof, to cause the resilient switch piece in question to contact or separate from the other resilient switch piece thereby, to set the above described other of ON-state and OFF-state when the pressure of the pressurized fluid is set in the range and the low-pressure snap disk means is the second configuration while the high-pressure snap disk means is in the first configuration, and thus the piston member is moved inward within the within the switch mechanism-containing chamber.

The piston member constructed as described above makes an operation of the dual-action switch unit more reliable, and that construction is more compact in construction.

It is also preferable that the dual-action pressure switch include a piston member-stopping means, mounted in the switch mechanism containing chamber so as to abut against the piston member, and which is moved inward within the switch mechanism-containing chamber by the low-pressure snap disk means changing configuration, from the first configuration to the second configuration, and to limit the moving distance of the piston member.

This piston member stopping means surely prevents the low-pressure snap disk means and the dual-action switch unit from being broken when the pressure of the pressurized fluid becomes higher than the lower limit of the certain range.

It is also preferable that the piston member stopping means is constructed by a stepped portion formed on the inner surface of the switch mechanism containing chamber in the inner space of the housing.

This stepped portion can be easily formed without increasing the number of component parts used in the dual-action switch apparatus and the dimension of the apparatus as well.

It is also preferable that the housing has a recess formed on the outer surface thereof and outwardly projected ends of the paired terminals are arranged in the recess.

This recess surely prevents the paired terminals from being damaged by force applied from outside.

It is also preferable that the recess of the housing, the switch mechanism containing chamber, the pressure actuating chamber, and the passage are arranged on a line, and the outwardly projected ends of the paired terminals are extended along the line.

This arrangement makes the whole size of the dual-action pressure switch apparatus become more compact.

The above stated object of the present invention also can be achieved by a dual-action pressure switch apparatus which becomes one of turned-on state and turned-off state when the pressure of a pressurized fluid is set in a certain range of values and which becomes the other of turned-on state and turned-off when the pressure of the pressurized fluid becomes lower than the lower limit of said certain range and higher than the upper limit thereof, said apparatus comprising: a housing having an inner space and a passage through which the pressurized fluid is introduced into the inner space; a diaphragm disposed in the inner space of the housing to sealingly pertitioned the inner space into a pressure actuating chamber communicated with the passage and a switch mechanism containing chamber shielded from the passage; a piston member arranged adjacent to the diaphragm in the switch mechanism containing chamber to be movable with the center portion of the diaphragm in a moving direction of the center portion of the diaphragm when the diaphragm is moved; a high-pressure snap disk means disposed in the switch mechanism containing chamber to be arranged adjacent to one side surface of the piston member which is located for away from the diaphragm, said high-pressure snap disk means being supported at the circumferential rim thereof by the inner circumferential surface of the switch mechanism containing chamber not to move in a direction in which said high-pressure snap disk means departs from the diaphragm, said high-pressure snap disk means being also transformable with a snap action between a first configuration in which its center portion is projected toward the diaphragm to move the piston member thereto and a second configuration in which its center portion is projected to move far away from the diaphragm to move the piston member inward in the switch mechanism containing chamber in the moving direction of said piston member, and said high-pressure snap disk means becoming the first configuration when the pressure of said pressurized fluid transmitted through the diaphragm and the piston member is lower than the upper limit of the certain range and becoming the second configuration when the pressure of the pressurized fluid is higher than the upper limit thereof; a low-pressure snap disk means disposed between the diaphragm and the other side surface of the piston member which is adjacent ot the diaphragm, said low-pressure snap disk means being transformable with a snap action between a first configuration in which its center portion is projected toward the diaphragm and a second configuration in which its center portion is projected to move far away from the diaphragm, and said low-pressure snap disk means becoming the first configuration when the pressure of the pressurized fluid transmitted through the diaphragm is lower than the lower limit of the certain range and becoming the second configuration when the pressure of the pressurized fluid is higher than the lower limit thereof; a low-pressure actuating rod inserted in the piston member and the high-pressure snap disk means so as to be movable in the moving direction of the piston member, relative to the piston member and the high-pressure snap disk means, by the transformation of said low-pressure snap disk means between the first configuration and the second configuration; a dual-action switch unit disposed in the switch mechanism containing chamber so as to be arranged more inwardly than the high-pressure snap disk means in the moving direction of said piston member, said switch unit having a pair of resilient switch pieces being made of electrically conductive material and separated from each other in the moving direction, and the paired resilient switch pieces being separated from or contact each other to set one of OFF-state and ON-state, when the pressure of the pressurized fluid is lower than the lower limit of the certain range and both of said high- and low-pressure snap disk means are under first configuration, one of the paired resilient switch pieces being pushed by the low-pressure actuating rod which moves inwardly in the switch mechanism containing chamber with the transformation of the low-pressure snap disk means from the first configuration to the second configuration and thus being transformed to contact or separate from the other resilient switch piece and to set the other of ON-state and OFF-state, when the pressure of said pressurized fluid is set in the certain range and the low-pressure snap disk means is under the second configuration while the high-pressure snap disk means is under the first configuration, and the other resilient switch piece being pushed by the high-pressure snap disk means which is under the second configuration or. the piston member which is moved inwardly in the switch mechanism containing chamber by the transformation of the high-pressure snap disk means from the first configuration to the second configuration, thus being transformed to separate from or contact the one resilient switch piece which has been transformed as described above to set the above described one of OFF-state and ON-state, when the pressure of the pressurized fluid is higher than the upper limit of the certain range and both of the low-and high-pressure snap disk means are under the second configuration; and a pair of terminals whose one ends are electrically connected to the paired resilient switch pieces of the dual-action switch unit while the other ends thereof being projected outside the housing.

DETAILED DESCRIPTION OF THE PREFERRED EMBODIMENTS

An embodiment of the present invention will be described in detail with reference to the accompanying drawings.

Figure 1:
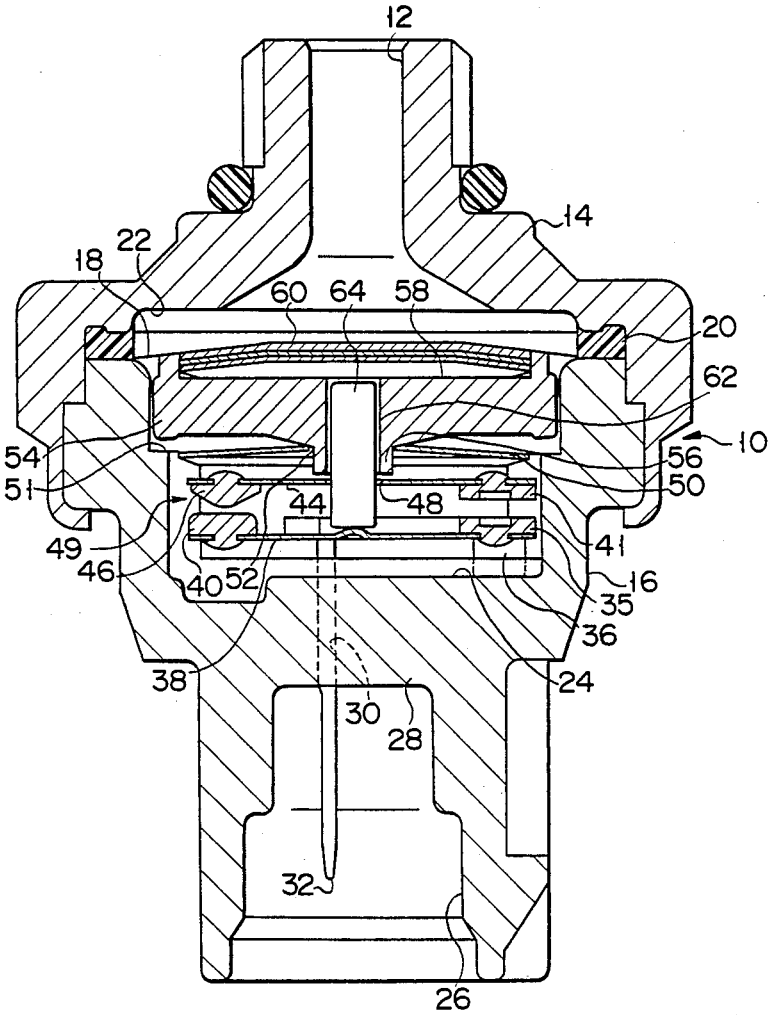
FIG. 1 is a longitudinal sectional view schematically showing a dual-action pressure switch apparatus according to one embodiment of the present invention, wherein the pressure of a pressurized fluid introduced into a pressure actuating chamber in the inner space of a housing does not increase and reach at the lower limit of a certain range of values.

Reference numeral 10 in FIG. 1 denotes a housing having an inner space. Housing 10 is made of metal and comprises first housing section 14 having passage 12 through which a pressurized fluid is introduced into the inner space, and second housing section 16 connected to first housing section 14 by the caulking at the open end of the inner space in first housing section 14. It is not necessarily needed that second housing section 16 is made air-tight, but it is preferable that no water enters into the inner space in second housing section 16. In this embodiment, second housing section 16 is therefore made of glass-fiber reinforced polybutylene terephthalate.

The opening of the inner space in second housing section 16, which opens at the end surface located adjacently to the connecting end of second housing section 16, is covered by diaphragm 18 made of polyimide resin, and the circumferential rim of diaphragm 18 located on the end surface of second housing section 16 is pressed against the inner surface of the inner space in first housing section 14 with ring-configuration packing 20 being interposed therebetween. Diaphragm 18 partitions the inner space of housing 10 into pressure actuating chamber 22, which is communicated with passage 12 in first housing section 14, and switch mechanism containing chamber 24, which is air-tightly shielded from pressure actuating chamber 22 by diaphragm 18, in second housing section 16.

Recess 26 is formed on an end surface of second housing section 16 which is far away from first housing section 14, and it, together with passage 12 and pressure actuating chamber 22 in first housing section 14 and switch mechanism containing chamber 24 in second housing section 16, is arranged on a line extending along the axial direction of housing 10.

Figure 2:
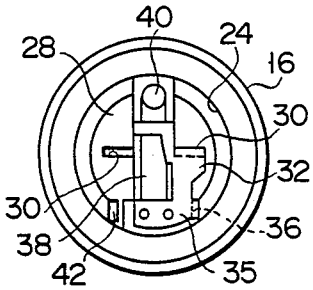
FIG. 2 is a plan view schematically showing one of a paired resilient switch pieces of a dual-action switch unit with a first housing section of the housing being removed, said switch piece being located in a switch mechanism containing chamber of a second housing section of the housing and resiliently transformable by a high-pressure actuating rod which is moved by the snap transformation of high-pressure snap disk means.

As shown in detail in FIG. 2, a pair of terminal insertion holes 30 are formed in partition wall 28, located between recess 26 and switch mechanism containing chamber 24, to open at one end switch mechanism containing chamber 24 and to open at the other end recess 26, and first and second terminal members 32 and 34 are inserted into holes 30 from switch mechanism containing chamber 24. Free ends of first and second terminal members 32 and 34 are located in recess 26 and FIG. 1 shows only first terminal member 32. As shown in FIGS. 1 and 2, the base portion of first terminal member 32 located in switch mechanism containing chamber 24 is extended along the bottom surface of switch mechanism containing chamber 24 and in a direction perpendicular to the line connecting paired terminal insertion holes 30, and its extended end 35 reaches at a position near the inner circumferential surface of switch mechanism containing chamber 24. A part of extended end 35 of the base portion of first terminal member 32 is bent toward partition wall 28 to form support piece 36, and support piece 36 is inserted into a recess formed in the bottom surface of switch mechanism containing chamber 24 to be supported. One end of first resilient switch piece 38, which is extended along the bottom surface of switch mechanism containing chamber 24 and in a direction substantially perpendicular to the terminal-insertion-holes-connecting line and crossing the center portion of the line, is fixed to extended end 35 of the base portion of first terminal member 32. First resilient switch piece 38 is made of electrically conductive and resilient material and contact 40 is fixed onto a side surface of the other end of first resilient switch piece 38, which is far away from the bottom surface of switch mechanism containing chamber 24.

Figure 3:
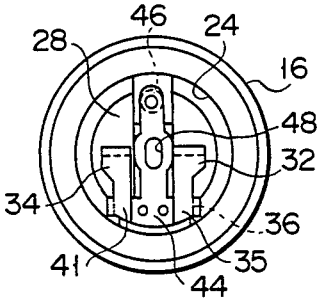
FIG. 3 is a plan view schematically showing the other of the paired resilient switch pieces of the dual-action switch unit with the first housing section removed, said the other resilient switch piece being located in the switch mechanism containing chamber of the second housing section of the housing and resiliently transformable by the piston member which is moved by the snap transformation of low-pressure snap disk means and the one resilient switch piece located under the other one also being schematically shown.

As shown in FIG. 3, the base portion of second terminal member 34 is also extended along the bottom surface of switch mechanism containing chamber 24 and in the direction substantially perpendicular to the terminal-insertion-holes-connecting line, and its extended end 41 is located above extended end 35 of the base portion of first terminal member 32 (or more remote from the bottom surface of switch mechanism containing chamber 24 than extended end 35). A part of extended end 41 of the base portion of second terminal member 34 is also bent toward partition wall 28 to form a support piece (not shown), and the support piece is also inserted into recess 42 formed in the bottom surface of switch mechanism containing chamber 24 (see FIG. 2) to be supported. One end of second resilient switch piece 44, which is extended above and along first resilient switch piece 38, is fixed to extended end 41 of the base portion of second terminal member 34. Second resilient switch piece 44 is also made of electrically conductive and resilient material and contact 46 is fixed onto the other end of second resilient switch piece 44 to face contact 40 on the other end of first resilient switch piece 38. As particularly shown well in FIG. 3, elongated through-hole 48 is formed at the center portion of second resilient switch piece 44 to face the intermediate surface of first resilient switch piece 38.

First and second resilient switch pieces 38 and 44 which are arranged and constructed as described above cooperate with each other to form dual-action switch unit 49 which achieves a certain operation as will be described later.

Low-pressure snap disk means 50 is further disposed in switch mechanism containing chamber 24 of second housing section 16 to be located above second resilient switch piece 44 (or nearer the diaphragm 18 than second resilient switch piece 44 is). In the embodiment, low pressure snap disk means 50 is formed by a sheet of snap disk and its circumferential rim is placed, on a small stepped portion located at the inner circumferential end of large ring-configuration stepped portion 51 which is formed on the inner circumferential surface of switch mechanism containing chamber 24 above second resilient switch piece 44. Low-pressure snap disk means 50 which comprises one sheet of snap disk is projected at its center portion upward like a convex, as shown in FIG. 1, and through-hole 52 is formed at the center thereof.

Piston member 54 is further disposed in switch mechanism containing chamber 24 of second housing section 16 so as to be located above low-pressure snap disk means 50. Piston member 54 is freely slidable in the axial direction of second housing section 16 at a large diameter area of the inner circumferential surface of switch mechanism containing chamber 24, and it is supported by the convex center portion of low-pressure snap disk means 50. The lower surface of piston member 54, which faces low-pressure snap disk means 50, is separated at the circumferential rim thereof by a certain distance from stepped portion 51, and low-pressure actuating projection 56 is formed at the center thereof to be inserted into through-hole 52 of low-pressure snap disk means 50 and to extends toward a position adjacent to the upper surface of second resilient switch piece 44.

The upper surface of piston member 54 contacts diaphragm 18, and shallow disk-like shaped receiving recess 58 having a flat bottom surface is formed in the upper surface. High-pressure snap disk means 60 which has substantially the same diameter as that of receiving recess 58 is arranged in receiving recess 58, and it is constructed by three sheets of snap disks. These three sheets of snap disks are overlapped one another with a lubricating material, which contains solid molybdenum disulfide, interposed therebetween so as to enable them to smoothly slide relative to one another. High-pressure snap disk means 60 is projected at its center portion upward like a convex and this convex upper face thereof contacts diaphragm 18 in FIG. 1.

Guide hole 62 is formed in the center of piston member 54 so as to extend in the axial direction of piston member 54. Guide hole 62 is opened both at the center of receiving recess 58 on the upper surface of piston member 54 and at the end surface of low-pressure actuating projection 56 on the lower surface of piston member 54.

High-pressure actuating rod 64 is inserted through guide hole 62 so as to be slidable in the axial direction of guide hole 62. The lower end of high-pressure actuating rod 64 is inserted into through-hole 48 formed in the center of second resilient switch piece 44 so as to contact the upper surface of first resilient switch piece 38. High-pressure actuating rod 60 is made of such a material that is so light as not to cause first resilient switch piece 38 to be substantially deflected and that can surely transmit the transformation of high-pressure snap disk means 60, which is caused by snap action as will be described later, to first resilient switch piece 38 without the transformation of rod 60.

When the dual-action pressure switch apparatus according to one embodiment of this invention and having the above-described arrangement is to be used, pressurized fluid passage 12 is connected to the pressurized fluid passage such as the refrigerant passage of refrigeration system (not shown) in the automotive air conditioner, for example, while the outwardly projected ends of first and second terminal members 32 and 34 are connected to electrical circuit such as the electrical circuit for the electric drive means in the compressor of refrigerating system (not shown), for example.

Figure 4:
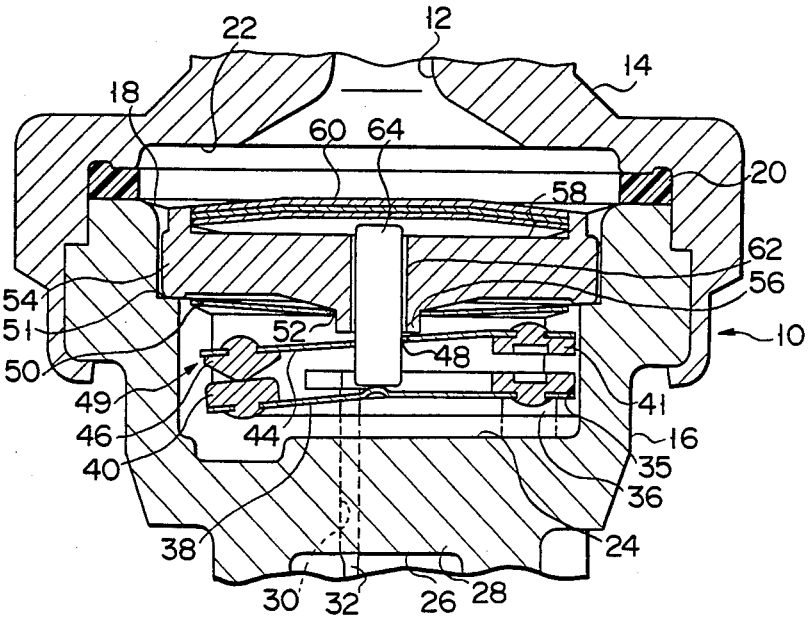
FIG. 4 is a longitudinal sectional view schematically showing the main portion of the dual-action pressure switch apparatus according to the present invention, wherein the pressure of the pressurized fluid introduced into the pressure actuating chamber in the inner space of the housing does not increase and reach at the upper limit of the certain range but increase and reach at the lower limit thereof.

When the gauge pressure of the refrigerant in the refrigerant passage increases and reaches at 250 kpa, low-pressure snap disk means 50 to which the pressure of the refrigerant introduced into pressure actuating chamber 22 is transmitted through diaphragm 18, high-pressure snap disk means 60, and piston member 54 is snap-transformed from a first configuration under which its center portion is projected upward as shown in FIG. 1 to a second configuration under which its center portion is projected downward as shown in FIG. 4. This transformation of low-pressure snap disk means 50 causes piston member 54 to be slid downward.

Low-pressure actuating projection 56 on the lower surface of piston member 54 slid downward pushes second resilient switch piece 44 downward, thereby causing contact 46 on second resilient switch piece 44 to be contacted with contact 40 on first resilient switch piece 38, as shown in FIG. 4. The electric circuit (not shown) is thus turned on.

The downwardly sliding movement of piston member 54 is stopped by the abutment of the circumferential rim of the lower surface of piston member 54 against stepped portion 51 of second housing section 16, as shown in FIG. 4. That is, stepped portion 51 serves as a means for limiting the downward moving distance of piston member 54.

The abutment of piston member 54 against stepped portion 51 prevents low-pressure snap disk means 50 from being too excessively transformed when the gauge pressure of the refrigerant becomes higher than 250 kpa, so that low-pressure snap disk means 50 is not plastically deformed even if the gauge pressure of the refrigerant becomes higher than 250 kpa. When the gauge pressure of the refrigerant becomes lower than 210 kpa in this embodiment, therefore, low-pressure snap disk means 50 can return from the second configuration shown in FIG. 4 to the first configuration shown in FIG. 2 thanks to its own resilience and another resilience stored in second resilient switch piece 44. This returning of low-pressure snap disk means 50 causes contact 46 of second resilient switch piece 44 to be separated from contact 40 of first resilience switch piece 38 to thereby turn off the electric circuit (not shown).

Figure 5:
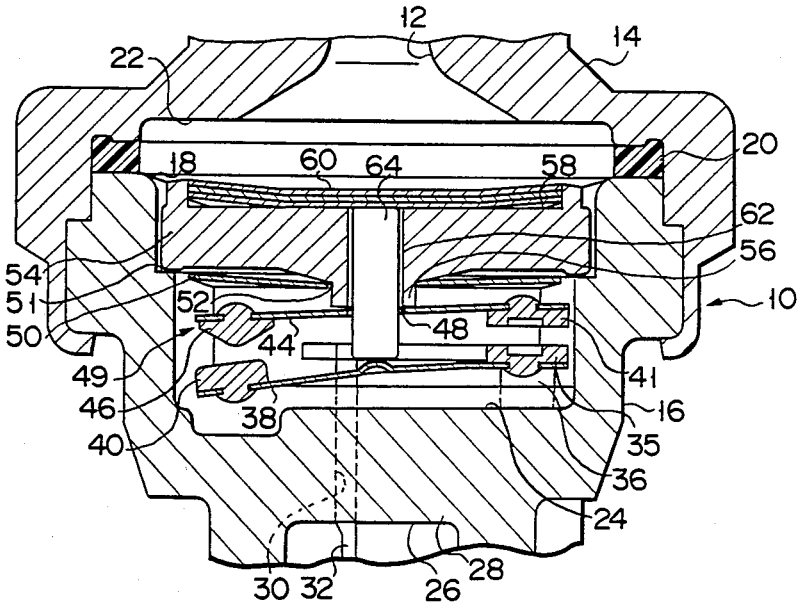
FIG. 5 is a longitudinal sectional view schematically showing the main portion of the dual action pressure switch apparatus according to the present invention, wherein the pressure of the pressurized fluid introduced into the pressure actuating chamber in the inner space of the housing increases and reaches at the upper limit of the certain range.

High-pressure snap disk means 60 does not make snap-transformation from the first configuration under which its center portion is projected upward as shown in FIGS. 1 and 4 to the second configuration under which its center portion is projected downward as shown in FIG. 5, until the gauge pressure of the refrigerant increases and reaches at 2.7 MPa in this embodiment. Until low-pressure snap disk means 50 is under the second configuration and high-pressure snap disk means 60 transforms to the second configuration, that is, when the gauge pressure of the refrigerant is in the range of 210 kpa to 2.7 MPa, the upper end of high-pressure actuating rod 64 is projected into receiving recess 58 on the upper surface of piston member 54, but a clearance is held between the lower surface of high-pressure snap disk means 60 whose center portion is projected upward and the top end of high-pressure actuating rod 64, as shown in FIG. 4. Therefore, first resilient switch piece 38 is neither pushed nor curved downward by high-pressure actuating rod 64 to separate its contact 40 from contact 46 of second resilient switch piece 44, thereby keeping the electric circuit (not shown) under on-state.

When the gauge pressure of the refrigerant increases and reaches at 2.7 MPa, low-pressure snap disk means 50 has been transformed to the second configuration as described above, and high-pressure snap disk means 60 is then transformed from the first configuration under which its center portion is projected upward as shown in FIGS. 1 and 4 to the second configuration under which its center portion is projected downward as shown in FIG. 5. The lower surface of the center portion of high-pressure snap disk means 60 which has been transformed to the second configuration pushes high-pressure actuating rod 64 downward to cause first resilient switch piece 38 to be curved downward to separate its contact 40 from contact 46 of second resilient switch piece 44, as shown in FIG. 5. As the result, the electric circuit (not shown) is turned off.

When the gauge pressure of the refrigerant becomes lower than 2.2 MPa in the above-described embodiment of the present invention, high-pressure snap disk means 60 can return from the second configuration shown in FIG. 5 to the first configuration shown in FIGS. 1 and 4 thanks to its own resilience and another resilience stored in first resilient switch piece 38. This returning of high-pressure snap disk means 60 causes contact 46 of second resilient switch piece 44 to be contacted with contact 40 of first resilient switch piece 38 as shown in FIG. 4, thereby turning on the electric circuit (not shown).

As described above in detail, the dual-action pressure switch apparatus according to the present invention turns off the electric circuit (not shown) except when the gauge pressure of the refrigerant becomes lower than 210 kpa after once the gauge pressure of the refrigerant becomes higher than 250 kpa and low-pressure snap disk means 50 is thus brought under the second configuration. When the gauge pressure of the refrigerant becomes lower than 210 kpa, therefore, the electric circuit (not shown) is turned off to thereby stop the compressor in the refrigeration system. The refrigeration system is rendered operative only when the gauge pressure of the refrigerant is in the certain range of 210 kpa to 2.7 Mpa after it once becomes higher than 250 kpa and remains below 2.7 Mpa.

As described above in detail, the dual-action pressure switch apparatus of the above described embodiment turns on when the pressure of the pressurized fluid is set in the certain range of values, and turns off when the pressure of the pressurized fluid is lower than the lower limit of the certain range and when the pressure is higher than the upper limit of the certain range.

According to the spirit of the present invention, however, the dual-action pressure switch apparatus may be so constructed as to be turned off when the pressure of the pressurized fluid is set in the certain range of values, and to be turned on when the pressure of the pressurized fluid is lower than the lower limit of the certain range and when the pressure of the pressurized fluid is higher than the upper limit of the certain range. The latter dual-action pressure switch apparatus may be used to turn on an alarm unit when the pressure of the pressurized fluid comes out the certain range of values.

Figure 6:
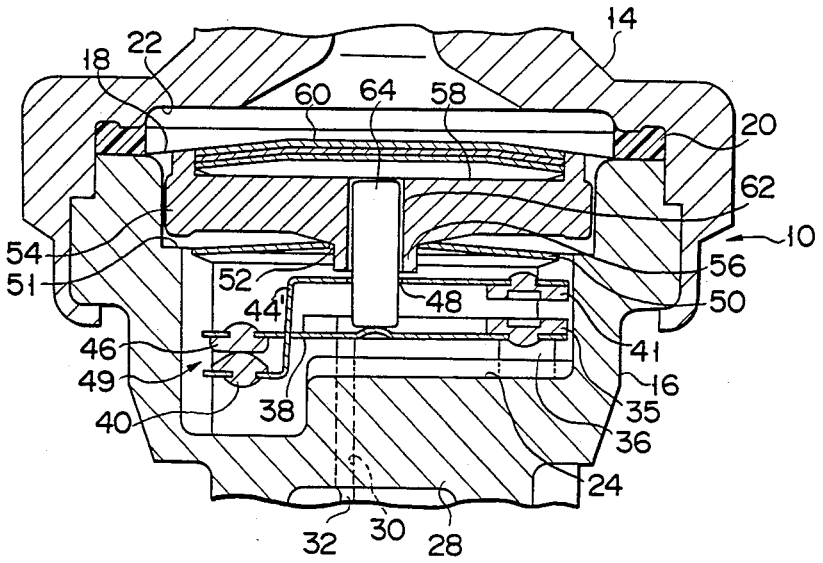
FIG. 6 is a longitudinal sectional view schematically showing the main portion of a first modification of the above stated embodiment of the invention, wherein the pressure of the pressurized fluid introduced in the pressure actuating chamber does not increase and reach at the lower limit of the certain range.
Figure 7:
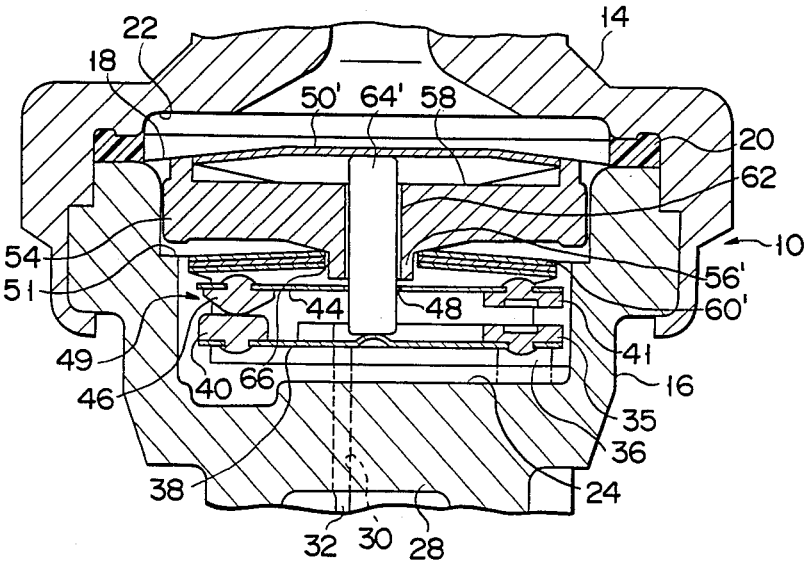
FIG. 7 is a longitudinal sectional view schematically showing the main portion of a second modification of the above stated embodiment of the invention, wherein the pressure of the pressurized fluid introduced in the pressure actuating chamber does not increase and reach at the lower limit of the certain range.

FIGS. 6 and 7 schematically shows longitudinal sections of main portions of first and second modifications of the embodiment of the present invention shown in FIGS. 1 to 5. Dual-action pressure switch apparatuses of the first and second modifications become turn-off state when the pressure of the pressurized fluid is set in a certain range of values, and become turn-on state when the pressure of the pressurized fluid become lower than the lower limit of the certain range and when the pressure of the pressurized fluid become higher than the upper limit of the certain range.

In the dual-action pressure switch apparatus, the free end of the second resilient switch piece 44' of the dual-action switch unit 49 is bent, as shown in FIG. 6, to be located under the free end of the first resilient switch piece 38. When the pressure of the pressurized fluid in pressure actuating chamber 22 is lower than the lower limit of the certain range of values, contact 40 of first resilient switch piece 38 and contact 46 of second resilient switch piece 44' contact each other, as shown in FIG. 6, to be set in turn-on state. When the pressure of the pressurized fluid in pressure actuating chamber 22 is set in the certain range and low-pressure snap disk means 50 is transformed to the second configuration in which the center portion thereof is projected downward, second resilient switch piece 44' pressed downward by low-pressure actuating projection 56 of piston member 54 moved to be abutted against stepped portion 51 is in turn-off state in which contact 40 of the free end of second resilient switch piece 44' separates downwardly from contact 46 of first resilient switch piece 38. And, when the pressure of the pressurized fluid in pressure actuating chamber 22 is higher than the certain range, and high-pressure snap disk means 60 is transformed to the second configuration in which the center portion thereof is projected downward, first resilient switch piece 38 pressed downward by high-pressure actuating rod 64 driven by transformed high-pressure snap disk means 60 is in turn-off state in which contact 46 of the free end thereof contacts again contact 40 of the free end of second resilient switch piece 44' which has been bent as described above.

In the dual-action pressure switch apparatus of the second modification, positions of low- and high-pressure snap disk means 50′ and 60′ are replace each other, as shown in FIG. 7, as compared with the above described embodiment. That is, low-pressure snap disk means 50′ is located in recess 58 in the upper surface of piston member 54, and high-pressure snap disk means 60′ engages at its circumferential rim with the inner circumferential edge of stepped portion 51. Opening 66 is formed in the center of high-pressure snap disk means 60′, and high-pressure actuating projection 56′ of piston 54 is inserted through opening 66. In the second modification, opening 52 (FIG. 1) is not formed at the center of low-pressure snap disk means 50′.

In the second modification, further, contact 40 of first resilient switch piece 38 and contact 46 of second resilient switch piece 44 is in turn-on state in which both contacts 40, 46 contact each other as shown in FIG. 7, when the pressure of the pressurized fluid in pressure actuating chamber 22 is lower than the certain rage of values. When the pressure of the pressurized fluid is set in the certain range and only low-pressure snap disk means 50′ is transformed to the second configuration in which the center portion thereof is projected downward, low-pressure actuating rod 64′ (functioned as a high-pressure actuating rod 64 in the embodiment shown in FIGS. 1 to 5) pressed by transformed low-pressure snap disk means 50′ presses first resilient switch piece 38 downward to separate contact 40 of the free end thereof from contact 46 of the free end of second resilient switch piece 44 and to set a turn-off state. When the pressure of the pressurized fluid becomes higher than the upper limit of the certain range and high-pressure snap disk means 60′ is also transformed to the second configuration in which the center portion thereof is projected downward, second resilient switch piece 44, which is pressed downward by high-pressure actuating projection 56′ (functioned as a low-pressure actuating projection 56 in the embodiment shown in FIGS. 1 to 5) of piston member 54 moved downward until it abuts against stepped portion 51, is set in the turn-on state in which contact 46 of the free end of second resilient switch piece 44 is contacted with contact 40 of the free end of first resilient switch piece 38.

By the way, in the second modification shown in FIG. 7, if the dual-action switch unit 49 having the construction as shown in FIG. 6 is used in place of the dual-action switch unit 49 having the construction as shown in FIG. 7, and the paired resilient switch pieces 38, 44 is so arranged as the separate both contacts 40, 46 of the free ends thereof from each other when the pressure of the pressurized fluid is lower than the lower limit of the certain range, the dual-action switch apparatus of the second modification becomes turn-on state when the pressure of the pressurized fluid is set in the certain range and becomes turn-off state when the pressure of the pressurized fluid is lower than the lower limit of the certain range and is higher than the upper limit of the certain range.

In the above embodiment and modifications, the magnitude of the pressure at which the high-pressure snap disk means 60, 60′ are transformed from the first configuration to the second configuration, when the pressure of the pressurized fluid increases, is higher than that of the pressure at which the high-pressure snap disk means 60, 60′ are transformed from the second configuration to the first configuration when the pressure of the pressurized fluid decreases.

In addition, magnitude of the pressure at which the low-pressure snap disk means 50, 50′ are transformed from the first configuration to the second configuration when the pressure of the pressurized fluid increases is higher than that of the pressure at which the low-pressure snap disk means 50, 50′ are transformed from the second configuration to the first configuration when the pressure of the pressurized fluid decreases.

As described above, since there is a wide range between the pressure at which the low-pressure snap disk means are transformed when the pressurized fluid increases, and the pressure, at which the low-pressure snaps disk means are reversely transformed when the pressure of the pressurized fluid decreases, and also there is a wide range between the pressure, at which the high-pressure snap disk means are transformed when the pressure of the pressurized fluid increases, and the pressure, at which the low-pressure snap disk means are reversely transformed when the pressure of the pressurized fluid decreases, the dual-action switch unit is prevented from chattering, so that the unit can stricity set ON-state or OFF-state in the dual-action pressure switch apparatus.

What is claimed is:

1. A dual-action pressure switch apparatus which becomes one of turned-on state and turned-off state when the pressure of a pressurized fluid is set in a certain range of values and which becomes the other of turned-on state and turned-off state when the pressure of the pressurized fluid becomes lower than the lower limit of said certain range and higher than the upper limit thereof, said apparatus comprising:

a housing having an inner space and a passage through which the pressurized fluid is introduced into the inner space;

a diaphragm disposed in the inner space of the housing to sealingly partition the inner space into a pressure actuating chamber communicated with the passage and a switch mechanism containing chamber shielded from the passage;

a piston member arranged adjacent to the diaphragm in the switch mechanism containing chamber to be movable with the center portion of the diaphragm in a moving direction of the center portion of the diaphragm when the diaphragm is moved;

a low-pressure snap disk means disposed in the switch mechanism containing chamber to be arranged adjacent to one side surface of the piston member which is located far away from the diaphragm, said low-pressure snap disk means being supported at the circumferential rim thereof by the inner circumferential surface of the switch mechanism containing chamber not to move in a direction in which said low-pressure snap disk means departs from the diaphragm, said low-pressure snap disk means being transformable with a snap action between a first configuration in which its center portion is projected toward the diaphragm to move the piston member thereto and a second configuration in which its center portion is projected to move far away from the diaphragm to move the piston member inward in the switch mechanism containing chamber in the moving direction of said piston member, and said low-pressure snap disk means becoming the first configuration when the pressure of said pressurized fluid transmitted through the diaphragm and the piston member is lower than the lower limit of the certain range and becoming the second configuration when the pressure of the pressurized fluid is higher than the lower limit thereof;

a high-pressure snap disk means disposed between the diaphragm and the other side surface of the piston member which is adjacent to the diaphragm, said high-pressure snap disk means being transformable with a snap action between a first configuration in which its center portion is projected toward the diaphragm and a second configuration in which its center portion is projected to move far away from the diaphragm, and said high-pressure snap disk means becoming the first configuration when the pressure of the pressurized fluid transmitted through the diaphragm is lower than the upper limit of the certain range and becoming the second configuration when the pressure of the pressurized fluid is higher than the upper limit thereof;

a high-pressure actuating rod inserted in the piston member and the low-pressure snap disk means so as to be movable in the moving direction of the piston member, relative to the piston member and the low-pressure snap disk means, by the transformation of said high-pressure snap disk means between the first configuration and the second configuration;

a dual-action switch unit disposed in the switch mechanism containing chamber so as to be arranged more inwardly than the low-pressure snap disk means in the moving direction of said piston member, said switch unit having a pair of resilient switch pieces being made of electrically conductive material and separated from each other in the moving direction, and the paired resilient switch pieces being separated from or contact each other to set one of OFF-state and ON-state, when the pressure of the pressurized fluid is lower than the lower limit of the certain range and both of said high- and low-pressure snap disk means are under first configuration, one of the paired resilient switch pieces being pushed by either the low-pressure snap disk means which is under the second configuration or the piston member which is moved inwardly in the switch mechanism containing chamber by the transformation of the low-pressure snap disk means from the first configuration to the second configuration and thus being transformed to contact or separate from the other resilient switch piece and to set the other of ON-state and OFF-state, when the pressure of said pressurized fluid is set in the certain range and the low-pressure snap disk means is under the second configuration while the high-pressure snap disk means is under the first configuration, and the other resilient switch piece being pushed by the high-pressure actuating rod which moves inward in the switch mechanism containing chamber with the transformation of the high-pressure snap disk means from the first configuration to the second configuration and thus being transformed to separate from or contact the one resilient switch piece which has been transformed as described above to set the above described one of OFF-state and ON-state, when the pressure of the pressurized fluid is higher than the upper limit of the certain range and both of the low- and high-pressure snap disk means are under the second configuration; and a pair of terminals whose one ends are electrically connected to the paired resilient switch pieces of the dual-action switch unit while the other ends thereof being projected outside the housing.

2. A dual-action pressure switch apparatus according to claim 1, wherein said housing includes a first housing section having a pressure actuating chamber and a passage through which the pressurized fluid is introduced into the pressure actuating chamber, and a second housing section having a switch mechanism containing chamber and detachably connected to the first housing section, wherein said diaphragm is sealingly secured at its circumferential rim to the connecting portion between the first and the second housing sections.

3. A dual-action pressure switch apparatus according to claim 1, wherein said diaphragm is a film of synthetic resin.

4. A dual-action pressure switch apparatus according to claim 1, wherein said high-pressure snap disk means comprises a plurality of snap disks coaxially overlapped one another.

5. A dual-action pressure switch apparatus according to claim 1, wherein one of the paired resilient switch pieces of said dual-action switch unit has a through-hole into which the high-pressure actuating rod is inserted, and the one of the paired resilient switch pieces is located nearer the low-pressure snap disk means than the other of the paired resilient switch pieces is.

6. A dual-action pressure switch apparatus according to claim 1, wherein said piston member has a low-pressure actuating projection formed in a ring configuration on the side surface of said piston member, which is far away from the diaphragm, to surround the peripheral surface of the high-pressure actuating rod and inserted through said low-pressure snap disk means to project toward the paired resilient switch pieces of said dual-action switch unit, and the low-pressure actuating projection pushes the one of the paired resilient switch pieces of the dual-action switch unit toward the other thereof to cause the one resilient switch piece to contact or separate from the other resilient switch piece to set the above described other of ON-state and OFF-state when the pressure of the pressurized fluid is set in the certain range and said low-pressure snap disk means is under the second configuration while said high-pressure snap disk means is under the first configuration and thus said piston member is moved inward in the switch mechanism containing chamber.

7. A dual-action pressure switch apparatus according to claim 1, wherein said apparatus further comprises a piston member stopping means mounted in the switch mechanism containing chamber to abut against said piston member, which is moved inward in the switch mechanism containing chamber by the transformation of said low-pressure snap disk means from the first configuration to the second configuration, and to limit the moving distance of the piston member.

8. A dual-action pressure switch apparatus according to claim 7, wherein said piston member stopping means is constructed by a stepped portion formed on the inner surface of the switch mechanism containing chamber in the inner space of said housing.

9. A dual-action pressure switch apparatus according to claim 1, wherein said housing has a recess formed on the outer surface and outwardly projected ends of said paired terminals are arranged in the recess.

10. A dual-action pressure switch apparatus according to claim 9, wherein the recess of said housing, the switch mechanism containing chamber, the pressure actuating chamber, and said passage are arranged on a line, and the outwardly projected ends of said paired terminals are extended along this line.

11. A dual-action pressure switch apparatus which becomes one of turned-on state and turned-off state when the pressure of a pressurized fluid is set in a certain range of values and which becomes the other of turned-on state and turned-off state when the pressure of the pressurized fluid becomes lower than the lower limit of said certain range and higher than the upper limit thereof, said apparatus comprising:

a housing having an inner space and a passage through which the pressurized fluid is introduced into the inner space;

a diaphragm disposed in the inner space of the housing to sealingly pertition the inner space into a pressure actuating chamber communicated with the passage and a switch mechanism containing chamber shielded from the passage;

a piston member arranged adjacent to the diaphragm in the switch mechanism containing chamber to be movable with the center portion of the diaphragm in a moving direction of the center portion of the diaphragm when the diaphragm is moved;

a high-pressure snap disk means disposed in the switch mechanism containing chamber to be arranged adjacent to one side surface of the piston member which is located far away from the diaphragm, said high-pressure snap disk means being supported at the circumferential rim thereof by the inner circumferential surface of the switch mechanism containing chamber not to move in a direction in which said high-pressure snap disk means departs from the diaphragm, said high-pressure snap disk means being also transformable with a snap action between a first configuration in which its center portion is projected toward the diaphragm to move the piston member thereto and a second configuration in which its center portion is projected to move far away from the diaphragm to move the piston member inward in the switch mechanism containing chamber in the moving direction of said piston member, and said high-pressure snap disk means becoming the first configuration when the pressure of said pressurized fluid transmitted through the diaphragm and the piston member is lower than the upper limit of the certain range and becoming the second configuration when the pressure of the pressurized fluid is higher than the upper limit thereof;

a low-pressure snap disk means disposed between the diaphragm and the other side surface of the piston member which is adjacent to the diaphragm, said low-pressure snap disk means being transformable with a snap action between a first configuration in which its center portion is projected toward the diaphragm and a second configuration in which its center portion is projected to move far away from the diaphragm, and said low-pressure snap disk means becoming the first configuration when the pressure of the pressurized fluid transmitted through the diaphragm is lower than the lower limit of the certain range and becoming the second configuration when the pressure of the pressurized fluid is higher than the lower limit thereof;

a low-pressure actuating rod inserted in the piston member and the high-pressure snap disk means so as to be movable in the moving direction of the piston member, relative to the piston member and the high-pressure snap disk means, the transformation of said low-pressure snap disk means between the first configuration and the second configuration;

a dual-action switch unit disposed in the switch mechanism containing chamber so as to be arranged more inwardly than the high-pressure snap disk means in the moving direction of said piston member, said switch unit having a pair of resilient switch pieces being made of electrically conductive material and separated from each other in the moving direction, and the paired resilient switch pieces being separated from or contact each other to set one of OFF-state and ON-state, when the pressure of the pressurized fluid is lower than the lower limit of the certain range and both of said high- and low-pressure snap disk means are under first configuration, one of the paired resilient switch pieces being pushed by the low-pressure actuating rod which moves inwardly in the switch mechanism containing chamber with the transformation of the low-pressure snap disk means from the first configuration to the second configuration and thus being transformed to contact or separate from the other resilient switch piece and to set the other of ON-state and OFF-state, when the pressure of said pressurized fluid is set in the certain range and the low-pressure snap disk means is under the second configuration while the high-pressure snap disk means is under the first configuration, and the other resilient switch piece being pushed by the high-pressure snap disk means which is under the second configuration or the piston member which is moved inwardly in the switch mechanism containing chamber by the transformation of the high-pressure snap disk means from the first configuration to the second configuration, thus being transformed to separate from or contact the one resilient switch piece which has been transformed as described above to set the above described one of OFF-state and ON-state, when the pressure of the pressurized fluid is higher than the upper limit of the certain range and both of the low-and high-pressure snap disk means are under the second configuration; and a pair of terminals whose one ends are electrically connected to the paired resilient switch pieces of the dual-action switch unit while the other ends thereof being projected outside the housing.

12. A dual-action pressure switch apparatus according to claim 11, wherein said housing includes a first housing section having a pressure actuating chamber and a passage through which the pressurized fluid is introduced into the pressure actuating chamber, and a second housing section having a switch mechanism containing chamber and detachably connected to the first housing section, wherein said diaphragm is sealingly secured at its circumferential rim to the connecting portion between the first and the second housing sections.

13. A dual-action pressure switch apparatus according to claim 11, wherein said diaphragm is a film of synthetic resin.

14. A dual-action pressure switch apparatus according to claim 11, wherein said high-pressure snap disk means comprises a plurality of snap disks coaxially overlapped one another.

15. A dual-action pressure switch apparatus according to claim 11, wherein one of the paired resilient switch pieces of said dual-action switch unit has a through-hole into which the low-pressure actuating rod is inserted, and the one of the paired resilient switch pieces is located nearer the high-pressure snap disk means than the other of the paired resilient switch pieces is.

16. A dual-action pressure switch apparatus according to claim 11, wherein said piston member has a high-pressure actuating projection formed in a ring configuration on the side surface of said piston member, which is far away from the diaphragm, to surround the peripheral surface of the low-pressure actuating rod and inserted through said high-pressure snap disk means to project toward the paired resilient switch pieces of said dual-action switch unit, and the high-pressure actuating projection pushes the one of the paired resilient switch pieces of the dual-action switch unit toward the other thereof to cause the one resilient switch piece to contact or separate from the other resilient switch piece to set the above described other of ON-state and OFF-state when the pressure of the pressurized fluid is set in the certain range and said low-pressure snap disk means is under the second configuration while said high-pressure snap disk means is under the first configuration.

17. A dual-action pressure switch apparatus according to claim 11, wherein said apparatus further comprises a piston member stopping means mounted in the switch mechanism containing chamber to abut against said member which is moved inward in the switch mechanism containing chamber by the transformation of said high-pressure snap disk means from the first configuration to the second configuration and to limit the moving distance of the piston member.

18. A dual-action pressure switch apparatus according to claim 17, wherein said piston member stopping means is constructed by a stepped portion formed on the inner surface of the switch mechanism containing chamber in the inner space of said housing.

19. A dual-action pressure switch apparatus according to claim 11, wherein said housing has a recess formed on the outer surface and outwardly projected ends of said paired terminals are arranged in the recess.

20. A dual-action pressure switch apparatus according to claim 19, wherein the recess of said housing, the switch mechanism containing chamber, the pressure actuating chamber, and said passage are arranged on a line, and the outwardly projected ends of said paired terminals are extended along this line.

* * * * *

UNITED STATES PATENT AND TRADEMARK OFFICE

CERTIFICATE OF CORRECTION

PATENT NO. : 4,827,094

DATED : May 2, 1989

INVENTOR(S) : Tanaka et al.

It is certified that error appears in the above-identified patent and that said Letters Patent is hereby corrected as shown below:

ON THE TITLE PAGE:

The inventor's name "Hirayosho Suzuki" should be spelled --Hirayoshi Suzuki--

Signed and Sealed this

Fifth Day of December, 1989

*Attest:*

JEFFREY M. SAMUELS

*Attesting Officer*

*Acting Commissioner of Patents and Trademarks*